United States Patent [19]

Mueller et al.

[11] 4,388,072

[45] Jun. 14, 1983

[54] DEPOSITING DEVICE FOR A PRE-FOLDED CONTINUOUS WEB OF PAPER IN A PAPER STACKER

[75] Inventors: Gerhard Mueller, Taufkirchen; Ernst Puritscher, Munich, both of Fed. Rep. of Germany

[73] Assignee: Siemens Aktiengesellschaft, Berlin & Munich, Fed. Rep. of Germany

[21] Appl. No.: 289,881

[22] Filed: Aug. 4, 1981

[30] Foreign Application Priority Data

Aug. 19, 1980 [DE] Fed. Rep. of Germany ..... 3031309

[51] Int. Cl.[3] ..... B65H 45/20

[52] U.S. Cl. ..... 493/410; 493/450

[58] Field of Search ..... 270/52.5; 493/450, 430, 493/433, 448, 409–415, 418; 226/118–119

[56] References Cited

U.S. PATENT DOCUMENTS 3,735,975 5/1973 Sukel ..... 493/410 X

FOREIGN PATENT DOCUMENTS 1180236 10/1964 Fed. Rep. of Germany .
2634300 2/1977 Fed. Rep. of Germany .
55-44421 3/1980 Japan ..... 493/411
118804 3/1956 U.S.S.R. ..... 493/413

*Primary Examiner*—A. J. Heinz
*Attorney, Agent, or Firm*—Hill, Van Santen, Steadman, Chiara & Simpson

[57] ABSTRACT

A stacker assembly for a prefolded continous web of paper is provided with an air jet means for directing an air stream onto the upper sheet of the paper stack being piled in the stacker to press down the folded edges in the stack. The direction and intensity of the air stream are controlled by means of a directional control device and an intensity control device. These control devices have variable settings in order to properly accommodate the particular form lengths of the paper being folded and the particular rigidity characteristics and weight of the paper. The two control devices may be connected via a mechanical coupling device so as to permit automatic adjustment in accordance with lateral displacement of form length guide walls positioned on opposed sides of the paper stack, these guide walls being displaced to accommodate prefolded web paper having different form lengths.

5 Claims, 4 Drawing Figures

DEPOSITING DEVICE FOR A PRE-FOLDED CONTINUOUS WEB OF PAPER IN A PAPER STACKER

BACKGROUND OF THE INVENTION

1. Field of the Invention

The invention concerns the device for depositing a prefolded continuous web of paper in a paper stacker.

2. The Prior Art

It is known to provide a prefolded continuous web of paper which has fold lines or edges spaced therealong at specific uniform intervals, which are called form lengths. Typically, such paper is fed through a high-speed printer and then layered in zig-zag fashion on a deposit surface for stacking.

The stacking operation of prefolded paper being delivered from the printer is highly prone to disruptions. For example, it often occurs that a fold line in the paper is smoothed as it is directed through the printer, such that the web of paper does not properly deposit in zig-zag fashion but rather is placed onto the depositing surface in a disordered manner. A similar effect occurs when air cushions form under the individual paper sheet layers during stacking which deflect the following web sheets in an incorrect direction. In instances where a form length guide wall device is used to position the paper stack, the paper web may overshoot the guide wall and lead to wave-like buldges in the stack which disrupts the stacking process. Another frequent cause for disruption in the stacking process is that the fold edges of the stacked paper do not properly fold over in a clinging fashion, such that the fold edge portions of the stack swell upward in a disorderly manner.

When stacking disruptions occur, it is necessary to interrupt the further feeding of paper into the stacker and to have a service person manually correct the disruption, which is costly and represents a considerable expenditure of time. Thus, it has been a problem in the art to provide a stacking device which guarantees a proper depositing of prefolded paper. One such stacking device is shown in German O.S. 26 34 300 in which a paper deposit device is disclosed utilizing two blowers for directing pressurized air onto the opposed fold edges of the paper stack. By this arrangement, fold edges of the uppermost sheet of the paper stack are pressed downward to provide a uniform stack pile. This assembly, however, has not been found to be completely satisfactory.

The present invention is directed to an inventive arrangement for stacking a prefolded continuous web of paper in a paper stacker which is substantially free of feed deposit disruptions.

SUMMARY OF THE INVENTION

A paper stacker is provided with a deposit surface onto which a prefolded continuous web of paper piles in zig-zag fashion. Overlying the sheet pile is at least one pressurized air jet means having a directional control device for adjusting the air stream of the air jet. By means of the control device, it is possible to direct the air stream precisely onto the region of the form length sheet being deposited such that air cushions are effectively expelled and the sheet is properly pressed into alignment in the stack.

There may also be provided paddle wheel assemblies located at opposed edges of the stack for the re-impression of the paper folds, in which case the air stream of the air jet means also serves to bring the continuous web of paper into operative engagement with the paddle wheels.

The stacker may readily be converted to handle paper webs having different form lengths in that the control device for the air jet means is adjustable to direct the air stream optimally for the particular form length being used.

In addition to the directional control device, there is also provided an intensity control device for the air stream of the air jet. The stacking behavior of the continuous web of paper is a function of the form length and the inherent rigidity and weight of the paper. The intensity of the air stream which is to expel air cushions forming in the stack and which is to press the paper being deposited onto the uppermost sheet of the paper stack must be accommodated to the stacking behavior of properties of the paper to assure proper stacking. Paper with high inherent rigidity requires a higher intensity air stream than light flexible paper and, on the other hand, an air stream intensity which is suitable for strong paper can proove to be too strong for light inflexible paper. An overly intense air stream can lead to fluttering and drifting of the paper web and thus cause disturbances in the stacking process. By providing an intensity control device, reimpression of the paper folds is also enhanced. The intensity control device is adjustable so that an optimum intensity of the air stream can be set for each kind of paper and thus decrease the chance of stacking disruption when different kinds of paper are stacked.

In accordance with a further embodiment of the invention, a mechanical coupling assembly is provided between form length guide wall means mounting in the stacker and the directional control device for the air jet means and/or the intensity control device for the air jet means dependent upon lateral positioning of a guide wall. The form length guide wall means are laterally adjusted to permit stacking of paper webs having different form lengths. A coupling device acts upon the control devices for the air jet such that movement of the guide wall means adjusts the direction and/or the intensity of the air stream for the air jet means to properly bear against that region of the uppermost sheet which is optimum to expel air cushions and press down the sheet for the particular form length being deposited. The coupling device permits an automatic adjustment of the air stream from the air jet and, thereby, produces the work necessary in order to set the air jet means to effect proper stacking for a particular form length of the paper web.

DESCRIPTION OF THE PREFERRED EMBODIMENTS

Figure 1:
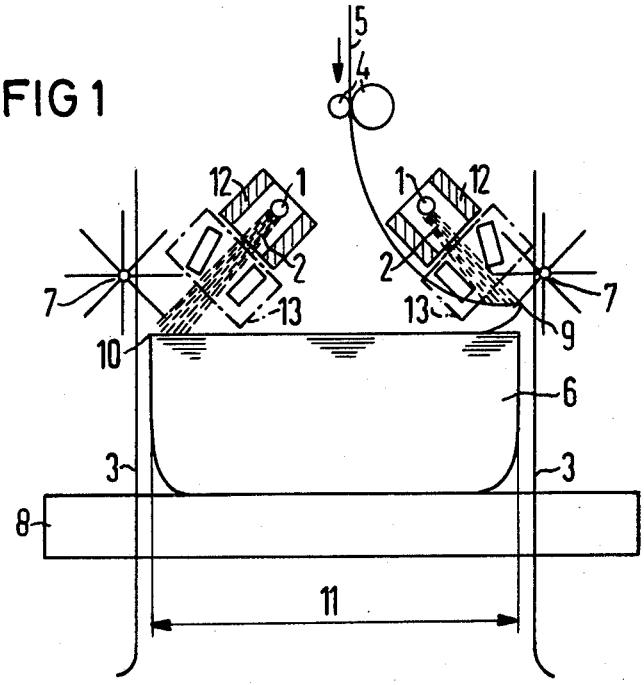
FIG. 1 is a schematic, side elevational view of a paper stacker for a prefolded continuous web of paper incorporating air jet means constructed in accordance with the present invention.

FIG. 1 illustrates a stacker device constructed in accordance with the present invention onto which a prefolded continuous web of paper 5 is deposited for piling in zig-zag fashion at fold lines or edges formed at form length intervals in the paper web. The paper web 5 is directed, such as from a high-speed printer, downwardly in the direction of the arrow between guide rollers 4 and passes laterally towards one side edge of the paper stack 6 due to the weight of the uppermost sheet previously deposited onto the stack. When the weight of the form length sheet being deposited becomes sufficiently great, this sheet bends over at its fold edge 9 and is then deflected towards the other side of the stack, whereupon the subsequent form length sheet to be deposited on a stack is then initially deflected towards that side of the stack.

The stacker assembly includes a deposit surface 8 onto which the paper stack 6 is piled and is bonded on opposed lateral sides by laterally adjustable form length guide walls 3 positioned adjacent opposed fold line portions 9 and 10 to vertically contain the stack 6. The space between the guide wall members 3 is widened or narrowed by conventional means not shown depending upon the particular form length 11 of the sheets in the paper web 5.

In order to obtain proper stacking of the paper web 5, the stacker assembly includes pressurized air jet means 1 for directing corresponding air streams 2 onto a region of the paper stack 6 which lies in the vicinity of the two fold edges 9 and 10. By virtue of the pressure of these air streams 2, the uppermost sheet of the paper stack 6 is pressed down onto the stack whereby proper alignment is attained and disturbances in the deposit of the paper web 5 are avoided. There is further provided paddle wheel devices 7 which overlie the fold edges 9 and 10 of the stack, so as to grasp the paper web 5 during deposit and re-impress the sheet fold edges.

The air jet means 1 are each provided with a directional control device 12 in the form of a tube-shaped member suitable for chanelling the air stream in a generally linear direction and an intensity control device 13 which utilizes relatively moveable flap members, further described below to control relative restriction of the air stream flow emanating from the air jet means. The directional control devices 12 are mounted for pivotal adjustment by means not shown and the flap members of the intensity control devices 13 may also be adjustably set. This adjustability permits the user to change the direction and intensity of each of the air streams 2 in accordance with the particular form length 11 of the paper sheets, the inherent rigidity of the paper, and the weight of the paper. Application of the air streams 2 is thus accommodated to the particular properties of the web paper being stacked. Furthermore, the air streams 2 can be set to blow the fold edges of the paper into the operative range of the paddle wheels 7 such that these wheels can reliably grasp the paper and re-impress the fold edges 9 and 10. If web paper 5 is being deposited with a larger form length, then the directional control device 12 is moved outward; whereas in the case of smaller form length, the directional control device is moved inward. If the web paper 5 is of a relatively stiff construction, then the intensity of the air stream 2 is increased in that the control flaps of the intensity control device 13 are opened; whereas in the case where the web paper 5 is of flexible and light material, the control flaps are brought closer together to restrict the air flow and lighten the intensity of the air stream being applied.

Adjustment of the directional control device 12 and/or the intensity control device 13 may be brought about in various ways. In the simplest form, adjustment may be done manually. It is further within the contemplation of the present invention that a servo-motor system may be provided to correspondingly displace the control devices. Furthermore, control of the intensity of the air streams 2 may be brought about by a variable speed motor drive connected to the blower which generates the air streams.

Figure 2:
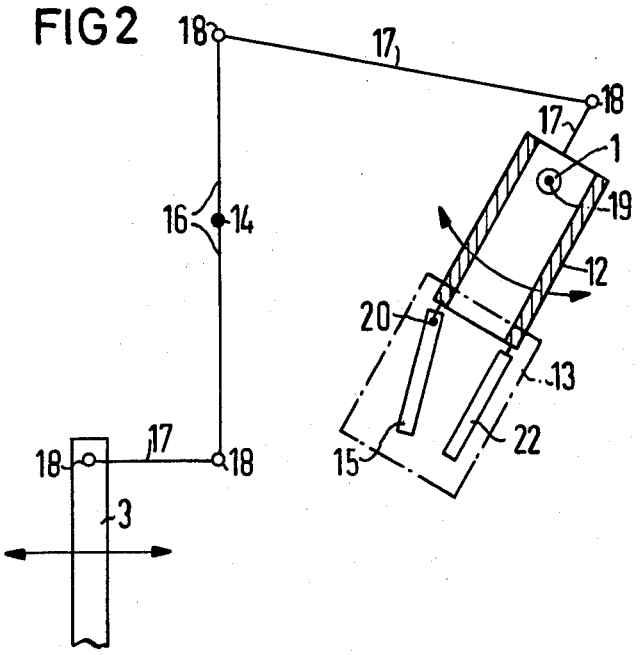
FIG. 2 is a fragmentary, schematic side elevational view of a coupling device for adjusting the setting of a directional control device for a paper stacker air jet means and dependence upon movement of a form length guide wall in accordance with the present invention.
Figure 3:
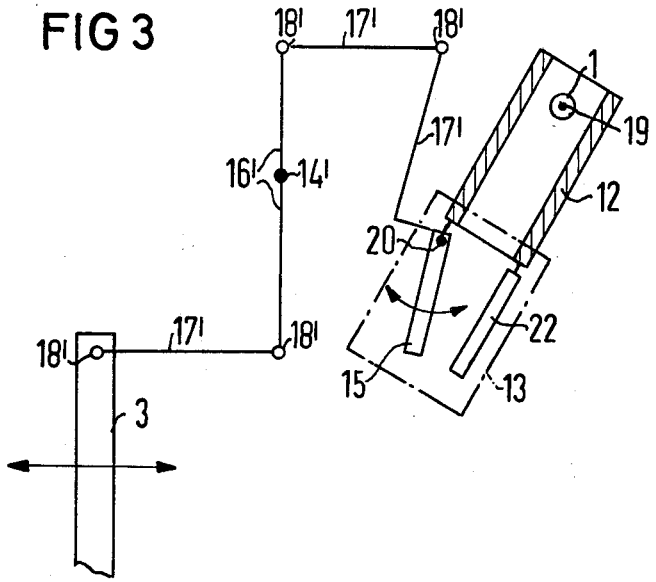
FIG. 3 is a fragmentary, schematic side elevational view of a coupling device for adjusting the setting of an intensity control device for a paper stacker air jet means and dependence upon movement of a form length guide wall in accordance with the present invention.
Figure 4:
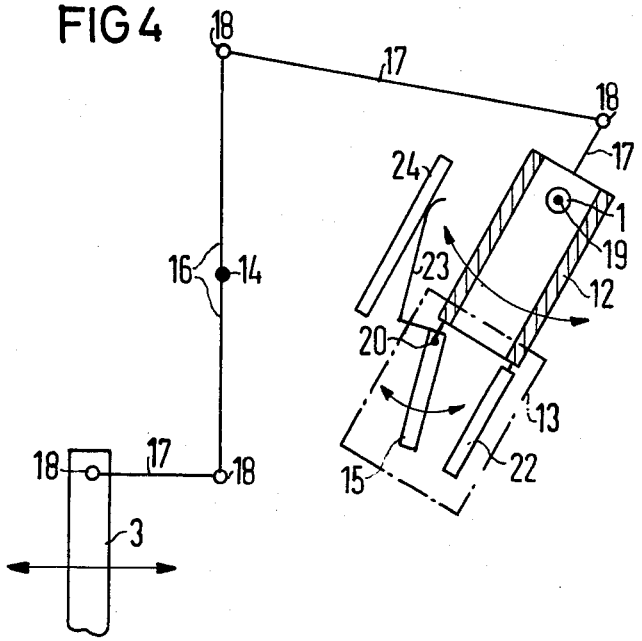
FIG. 4 is a fragmentary, schematic side elevational view of a coupling device for adjusting settings for a directional control device and intensity control device for a paper stacker air jet means and dependence upon positioning of a form length guide wall.

FIGS. 2–4 illustrate various arrangements for effecting automatic adjustment of the directional and intensity control devices 12 and 13 in accordance with the present invention. In FIG. 2, the directional control device 12 is connected via a coupling linkage device 17 with the form length guide wal1 3, such that adjustment of the guide wall 3 brings about an automatic adjustment of the setting for the directional control device 12. The coupling linkage is divided into segments interconnected at hinge member portions 18 and includes a lever member 16 which is supported for pivotal movement about a fixed fulcrum point 14. The intensity control device 13 comprises a fixed control flap 23 and a moveable control flap 15 positioned at the delivery end of the directional control 2. The opening and closing of the intensity control flaps are not directly influenced by the movement of the coupling linkage 17. Instead, the moveable flap 15 is pivotably supported in a hinge 20, such that adjustment of the intensity control device opening is brought about by the operator manually setting the relative position of the moveable flap 15. The intensity control device 13 is fixably connected to the directional control device 12. The directional control device 12 is supported for pivotal movement about a pivot point 19.

As a result of the coupling linkage 17, the directional control device 12 is pivoted in the direction of the arrow shown in FIG. 2 upward or downward as a result of lateral shifting of the form length guide wall 3 outward or inward, respectively. The guide wall 3 is adjusted to allow for the deposit of web paper 5 in the stacker assembly having a different form length. The amount of movement affected to the directional control device 12 is determined by means of the lever portion 16, which acts a motion converting device. As a result of this movement, the direction of the air stream 2 emanating from the directional control tube can be directed onto the desired region of the uppermost sheet of the paper stack 6 to affect proper stacking of the paper. It is further within the contemplation of the present invention that some other type of motion converting device other than the lever 16 can be utilized which does not translate motion of the guide wall 3 in a unitary proportion to the directional control device 12, such that adjustment of the direction of the air stream 2 can be more finely tuned. It is further within the contemplation of the present invention that the air jet means 1 can be arranged outside of the directional control device 12, if such is desired.

In FIG. 3, a coupling linkage 17' is provided which operates in a similar manner with the linkage 17 described above and, accordinly, like elements are indicated by the earlier mentioned numerals with primes. The coupling linkage 17' serves to connect the form length guide wall 3 with the intensity control device 13 such that adjustment of the guide wall 3 brings about an automatic adjustment of the setting for the moveable control flap 15. In this manner, lateral movement of the guide wall 3 brings about adjustment of the intensity control device opening. As a result of the coupling linkage 17', the intensity control device is relatively opened or closed by means of displacement of the moveable flap 15 upward or downward, respectively, as a function of the outward or inward, respectively, displacement of the guide wall 3. The intensity control device 13, comprising the stationary control flap 22 and moveable control flap 15, is fastened to the directional control device 12 at the air stream discharge end thereof. The directional control device 12 may be fixably or moveably mounted in the stacker assembly.

FIG. 4 illustrates a further embodiment wherein variable adjustment of the direction control device 12 and intensity control device 13 is brought about as a function of the lateral displacement of the guide wall 3. The coupling linkage 17 described above in connection with FIG. 2 is utilized to bring about the positional adjustment of the direction control device 12. A further coupling device is provided which comprises a fixed stop wall 24 along which slides a position guide arm 23 fastened to the moveable control flap 15. This coupling device has the effect that, as the directional control device 12 is moved upward or downward about its pivot point 19 as the result of lateral movement of the guide wall 3 outward or inward, respectively, the moveable control flap 15 is moved upward or downward, respectively, about its pivot point 20. In this manner, adjustment of the setting for the directional control device 12 and the intensity control device 13 occurs simultaneously as a result of displacement of the guide wall 3.

Although various minor modifications may be suggested by those versed in the art, it should be understood that we wish to embody within the scope of the patent warranted hereon, all such modifications as reasonably and properly come within the scope of our contribution to the art.

We claim as our invention:

1. A stacker assembly for piling a prefolded continuous web of paper sheets comprising a surface onto which said sheets are piled, means for directing said sheets in consecutive fashion downwardly into said stack such that opposed folded edges of each sheet lie laterally over said surface, an air jet means for directing a pressurized air stream against at least one folded edge of the uppermost piled sheet to press said folded edge down onto the pile, a moveable directional control means for adjusting the direction of said air stream, in order to accommodate sheets of different form lengths and at least one guide wall means adjacent one folded edge side of the pile, said guide wall means being laterally displaceable to accommodate sheets of different form lengths and a coupling means for automatically moving said directional control means responsive to displacement of said guide wall means.

2. The stacker assembly of claim 1, further comprising a variable intensity control means for adjusting the pressure of said air stream in order to accommodate sheets having different rigidity and weight characteristics.

3. A stacker assembly for piling a prefolded continuous web of paper sheets comprising a surface onto which said sheets are piled, means for directing said sheets in consecutive fashion downwardly into said stack such that opposed folded edges of each sheet lie laterally over said surface, an air jet means for directing a pressurized air stream against at least one folded edge of the uppermost piled sheet to press said folded edge down onto the pile, a variable intensity control means for adjusting the pressure of said air stream, in order to accommodate sheets having different rigidity and weight characteristics, at least one guide wall means adjacent one folded edge side of the pile, said guide wall means being laterally displaceable to accommodate sheets of different form lengths and a coupling means for automatically adjusting said intensity control means responsive to displacement of said guide wall means.

4. The stacker assembly of claim 3, further comprising a moveable directional control means for adjusting the direction of said air stream in order to accommodate sheets of different form lengths.

5. The stacker assembly of claim 3, wherein said intensity control means comprises two spaced-apart flap members positioned downstream of said air jet means, one flap member being pivotably moveable relative to the other for relative restriction of said air stream.

* * * * *